United States Patent [19]

Weingartner

[11] Patent Number: 4,657,327

[45] Date of Patent: Apr. 14, 1987

[54] ELECTRICAL CONNECTOR ASSEMBLY

[75] Inventor: Bernhard Weingartner, Feldkirch, Austria

[73] Assignee: Neutrik Aktiengesellschaft, Schaan, Liechtenstein

[21] Appl. No.: 817,081

[22] Filed: Jan. 3, 1986

Related U.S. Application Data

[63] Continuation of Ser. No. 500,208, Jun. 2, 1983, abandoned.

[30] Foreign Application Priority Data

Jun. 8, 1982 [AT] Austria ..... 2233/82

[51] Int. Cl.[4] ..... H01R 25/00

[52] U.S. Cl. ..... 339/49 B; 339/48; 339/59 R; 339/76 M

[58] Field of Search ..... 339/48, 49 R, 49 B, 339/59 R, 59 M, 61 R, 61 M, 76, 176

[56] References Cited

U.S. PATENT DOCUMENTS

| | | | |
|---|---|---|---|
| 2,741,750 | 4/1956 | Barre, Jr. | 339/217 S |
| 3,753,212 | 8/1973 | Yamada et al. | 339/49 R |
| 3,840,839 | 10/1974 | Smaczny et al. | 339/49 R |
| 4,329,008 | 5/1982 | Braginetz | 339/217 S |
| 4,455,056 | 6/1984 | Hermann, Jr. et al. | 339/49 R |
| 4,501,459 | 2/1985 | Chandler et al. | 339/49 B |

*Primary Examiner*—Gil Weidenfeld
*Assistant Examiner*—Paula A. Austin
*Attorney, Agent, or Firm*—Toren, McGeady and Goldberg

[57] ABSTRACT

A first and a second connector member adapted to be plugged together to establish an electrical connection therebetween are each formed to include a housing member, a contact element carrier made of electrically insulating material mounted within the housing, and elongate contact elements mounted in the carrier and adapted to be placed in electrical conducting engagement with each other when the first and second connector members are plugged together, the contact elements being arranged to be brought into abutting engagement in pairs with their longitudinal axes extending parallel to each other, the contact elements including contact portions which comprise at least parts thereof having a generally planar configuration, with the contact elements being supported in the carrier so that the planar portions thereof are arranged with their planes extending perpendicularly relative to each other when the first and second connector members are plugged together.

15 Claims, 13 Drawing Figures

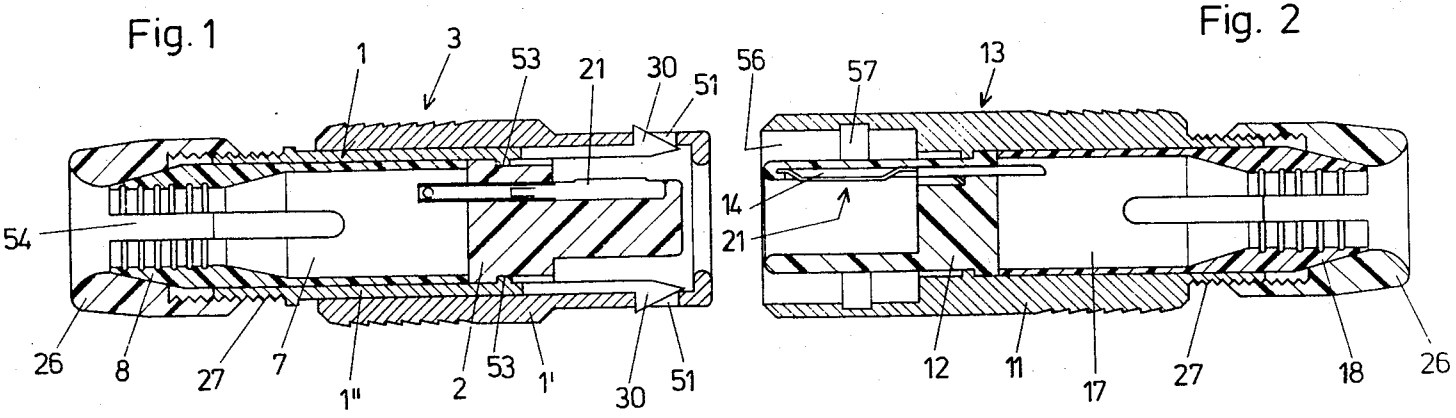
Fig. 2
Fig. 1
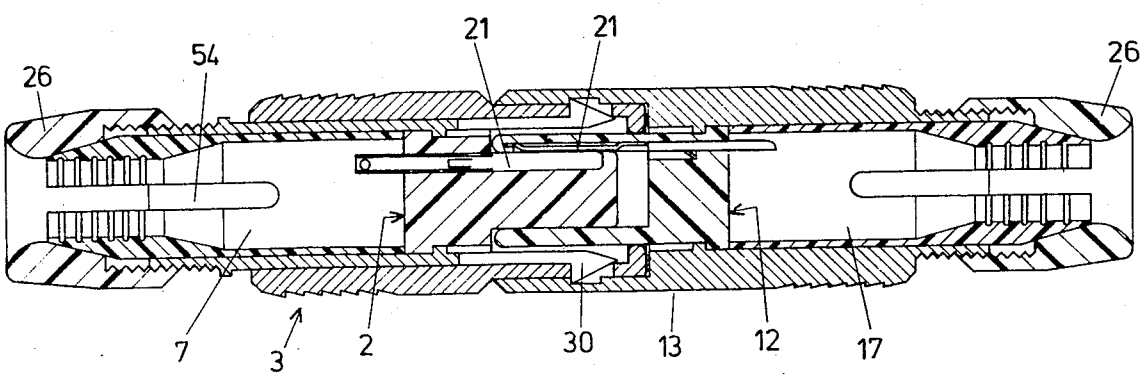
Fig. 3

22
23
24
25
21
60
62
61
12
14
15
16
19
55
9
6
4
2
52
5

ELECTRICAL CONNECTOR ASSEMBLY

This is a continuation of application Ser. No. 500,208, filed June 2, 1983, now abandoned.

The present invention relates generally to electrical connection apparatus and more particularly to an electrical plug or connector assembly wherein two connector members are arranged to be plugged together to establish an electrical connection and to be unplugged by disconnection thereof.

In devices of the type to which the present invention relates each of the connector members is usually formed with a contact element carrier which is made from electrically insulated material and which is received within a connector housing. Contact elements for the two connector members are formed with an elongated configuration and they are mounted on the carrier. In the plugged or interconnected position of the connection members, the contact elements have longitudinal axes which, for each pair of interconnected contact elements, will lie substantially parallel relative to each other.

Electrical plug connector assemblies and particularly the contact elements which are provided therein are generally utilized for the purpose of transmitting electrical currents or signals without loss and without interference. Such interconnection apparatus must function in a manner as though line transmission therethrough was not interrupted at all at the location of the connector assembly. In modern electronics, wherein many input and output systems are utilized, sensors, control and regulating members, actuating mechanisms, and system component parts must all be electrically connected with each other. However, quite often these devices are constructed so as to be mechanically separated so that the electrical interconnection therebetween may be broken. In such systems particularly the contact elements themselves acquire increasing importance.

In data processing equipment and process control devices, multiple-pole plug connections are particularly needed with increasing frequency. An important consideration is to avoid physical structures which are unwieldy in size and therefore space-saving considerations are particularly significant.

However, in addition to the foregoing parameters, modern connection systems must also be suited for industrial large-scale assemblies as well as for manual assembly. Moreover, the point of connection between the contact elements should be capable of being connected not only by means of soldering, but also by means of modern connection methods such as crimping, wire wrapping, or insulation displacement. As a result, the contact elements must be constructed so as to be as universally usable as possible in order to be suitable for all modern applications with as little modification as possible. Moreover, modern contact elements should be constructed so that, in view of the high price of gold, they may be only partially gold plated, for example at the actual contact surfaces.

It would be desirable, additionally, if in the interest of achieving the greatest possible simplification and universality of use, two geometrically different elements, for example pin and socket, which previously were necessary for producing a contact could be replaced by a single element. That is, it would be of substantial advantage if it were possible to employ two identically structured elements for producing a contact pair. In addition, such a contact element should be capable of being fixed at the connection line in a loose state, if possible, without being inserted or fastened in the contact element carrier or connector, respectively, and it should be affixed specifically with one of the aforementioned techniques and only then introduced into the contact element carrier and anchored there.

Moreover, it is of substantial significance in a modern interconnection system for the contact geometry to be formed in such a way as to ensure a secure contacting force or surface pressure on the one side without plastic deformation or fatigue and, in addition, to provide self-cleaning of the contact surfaces during the connection process without creating abrasive damage or scratching of the contact surfaces.

Accordingly, the present invention is directed toward providing an electrical connector assembly which exhibits improvements over prior art devices.

SUMMARY OF THE INVENTION

Briefly, the present invention may be described as an electrical connector assembly formed of a first and a second connector member adapted to be plugged together to establish electrical interconnection therebetween, each of said first and second connector members comprising: housing means, contact element carrier means made of electrically insulating material mounted within said housing means; elongate contact elements mounted in said carrier means having longitudinal axes and adapted to be placed in electrically conductive engagement with each other in pairs with said longitudinal axes extending parallel to each other when said first and second connector members are plugged together; said contact elements having contact portions which are brought into abutting contact with each other and which are formed to comprise at least parts thereof having a generally planar configuration, with said contact elements being supported in said carrier means so that said planar parts are arranged with their planes extending perpendicularly to each other when said first and second connector members are plugged together.

Thus, in accordance with the invention, the complex problems of the prior art are solved in that strip-like or band-like contact lugs or elements are supported in part and at least on one side by the contact element carriers along their contact length and that they are provided as contact elements in the contact carriers of the two connector parts, with the two contact lugs forming a contact pair being arranged with their geometric preference planes substantially at right angles relative to one another.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

In the drawings:

FIG. 1 is a section view of the first of two connector members forming a part of the connector assembly of the invention;

FIG. 2 is a sectional view of the second connector member of the invention;

FIG. 3 is a sectional view showing the two connector members of the connector assembly of the invention plugged together in electrically conductive engagement;

DETAILED DESCRIPTION OF THE PREFERRED EMBODIMENTS

Figures 4, 5:
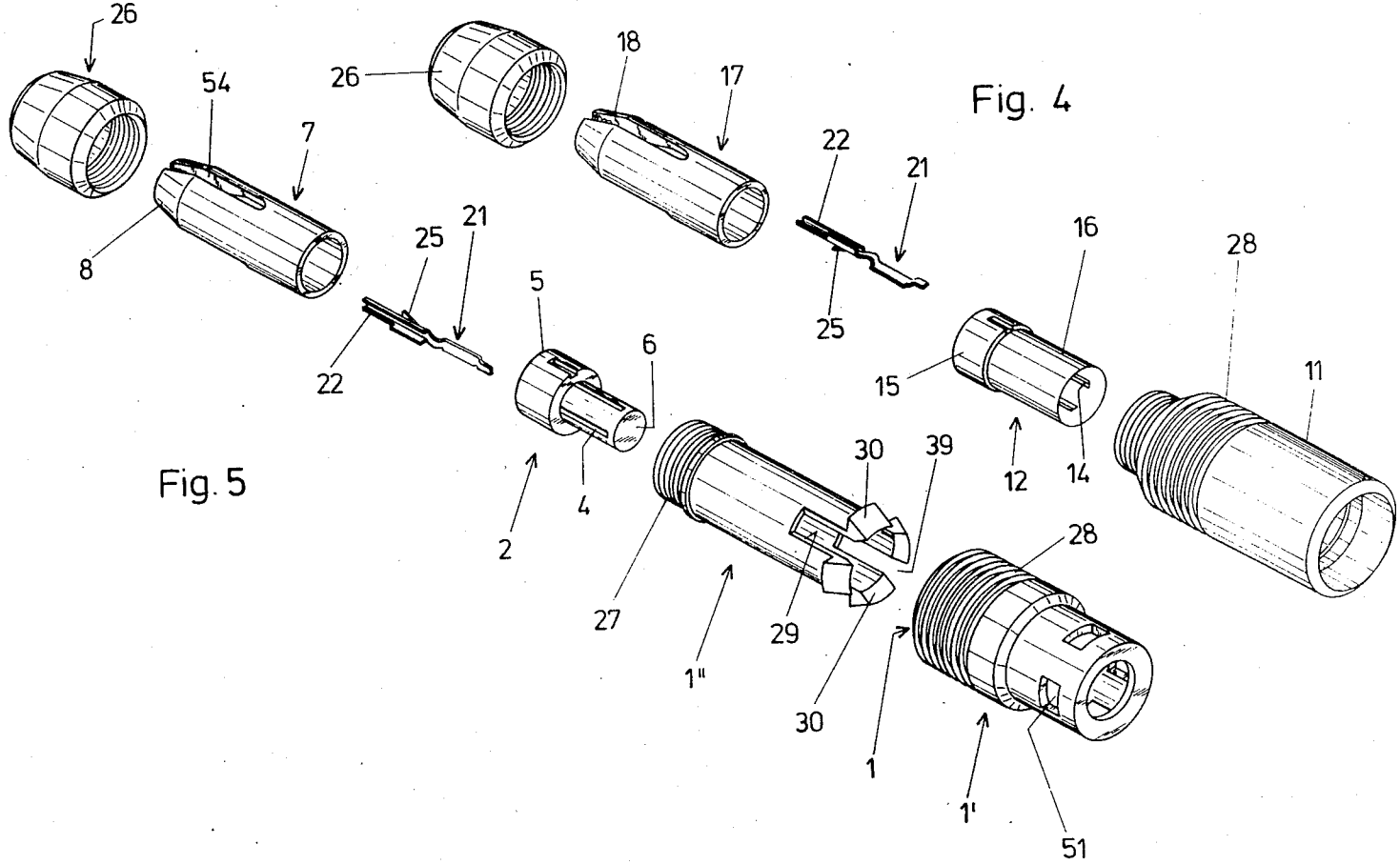
FIGS. 4 and 5 are perspective exploded views showing, respectively, the parts of the second and the first connector members shown in FIGS. 2 and 1.

Referring now to the drawings, and particularly to FIGS. 1, 2, and 3, there is shown a connector assembly in accordance with the present invention which is basically comprised of a first connector member 3 shown in FIG. 1 and a second connector member 13 shown in FIG. 2. The connector members 3 and 13 are complementary relative to each other and they may be plugged together, this plugged interconnection thereof being depicted in FIG. 3.

The connector member 3 is formed to include a connector housing 1 which is constructed in two parts including a first housing sleeve 1″ having a screw thread 27 at one end thereof and a second housing sleeve 1′. The front or forwardmost section of the first sleeve 1″ is formed to define four members 30 which are separated by longitudinal slots 29, best seen in FIG. 5.

The sleeve 1′ is adapted to slide over the sleeve 1″, and the sleeve 1′ is formed with ribbing 28 on the outer surface thereof in order to facilitate gripping of the sleeve 1′ for easier handling of the connector parts.

The sleeve 1′ is formed with four notches or cutouts 51 which serve to receive therein the detent members 30. The two sleeves 1′ and 1″ are axially displaceable relative to each other.

Figures 6, 7, 8, 9, 10:
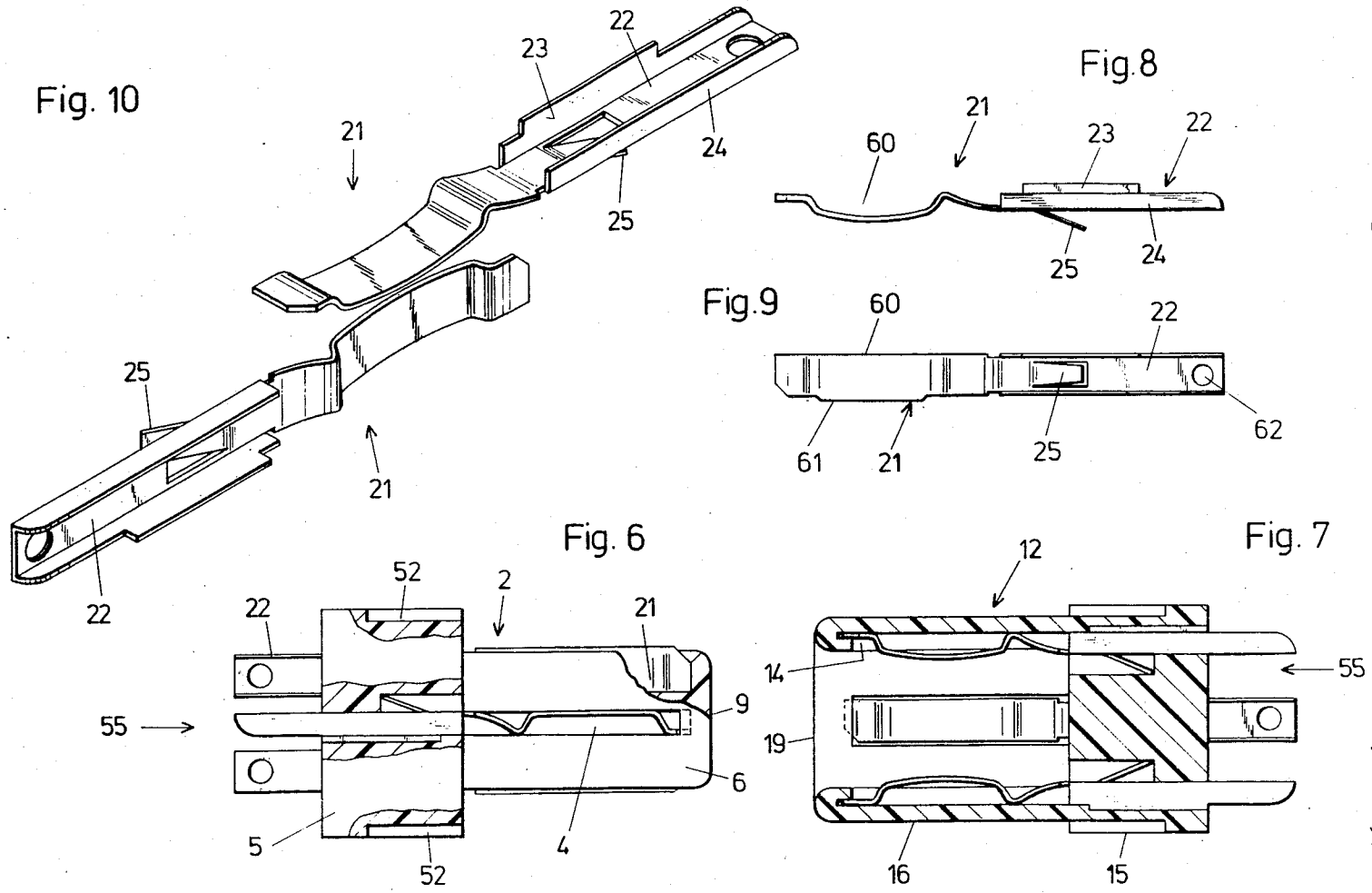
FIG. 6 is a sectional view showing the contact element carrier of the connector member of FIG. 1.
FIG. 7 is a sectional view showing the contact element carrier of the connector member of FIG. 2.
FIG. 8 is a side view of a contact element in accordance with the present invention.
FIG. 9 is a plan view of the contact element of FIG. 8.
FIG. 10 is a perspective view showing the general positions of the contact elements of the invention when they are brought into electrically conductive engagement.

The first connector member 3 also includes a contact element carrier 2 which is formed of electrically insulating material and which is shown on an enlarged scale in FIG. 6. The contact element carrier 2 is inserted in the connector housing 1 as shown in FIG. 1, and it is constructed as a unitary member comprising two cylindrical sections 5 and 6, the cylindrical section 5 having a larger diameter than the cylindrical section 6. The section 5 contacts the inside of the housing 1 and it is formed with grooves 52 along its border within which there engage correspondingly formed noses or spring members 53 formed on the inner side of the first sleeve 1″ in order to position the contact element carrier 2 within the housing 1.

The connector member 3 also includes a clamping sleeve 7 which is inserted in the housing 1, the clamping sleeve 7 being manufactured of plastic material and having an end area formed with longitudinal slots 54 and with a tapered or conical end 8 which tapers to a reduced diameter toward the end of the sleeve 7.

It will be seen that the second connector member 13 is similarly formed with a housing sleeve 11 having mounted therein a contact element carrier 12 which is structured somewhat differently from the contact element carrier 2 of the connection member 3. The contact element carrier 12 is also arranged to have mounted therein contact elements 21 which are identical in structure and configuration with the contact elements 21 mounted in the connection member 3.

Furthermore, the second connector member 13 is also formed with a clamping sleeve 17 which is generally identical in structure to the clamping sleeve 7 formed in the first connector member 3.

In addition to the foregoing, each of the connector members 3 and 13 have attached at the rearward ends thereof, i.e., the left end of the connector member 3 as seen in FIG. 1 and the right end of the connector member 13 as seen in FIG. 2, a clamping ring 26. As will be apparent from FIGS. 1 and 2, the clamping sleeve 17 is formed with screw threads 27 similar to the threads 27 formed on the clamping sleeve 7. Each of the clamping nuts 26 is adapted to be threadedly engaged on the clamping sleeve 7, 17, respectively, by threaded engagement with the threads 27.

As will be seen from FIGS. 1 and 2, the clamping sleeve 17 is also formed with a tapered end 18 similar to the tapered end 8 of the clamping sleeve 7. The clamping nuts 26 are adapted on the inner surface thereof to engage the outer surfaces of the tapered ends 8, 18 of the clamping sleeves 7, 17 when the clamping nuts 26 are screwed onto the housings of the connector members 3, 13. Thus, by tightening the clamping nuts 26, the inner sides thereof will press the clamping sleeves 7, 17 inwardly of the connector members 3, 13 and, as will be apparent from FIGS. 1 and 2, each of the clamping sleeves 7, 17 will be brought into end-to-end abutting engagement, respectively, with the contact element carriers 2, 12. Thus, by operation of the clamping nuts 26 and of their screw threaded engagement on the housing means of the connector members 3, 13, the clamping sleeves 7, 17 will be urged against the contact element carriers 2, 12 and therefore positioning of the parts within the housing means of the connector members will be facilitated.

The contact element carrier 2 is shown in greater detail in FIG. 6, and the contact element carrier 12 is shown in greater detail in FIG. 7. In the contact element carrier 2 there are formed axially parallel grooves 4 in the circumference of the cylindrical section 6 with the grooves 4 extending into slits or openings in the cylindrical section 5, the contact lugs 21 being inserted from the rearward side of the connector members in the direction of the arrow 55 into these openings.

The contact lugs or elements 21 which are constructed identically for both of the connector members 3 and 13 are shown in FIGS. 8 and 9. It will be seen that the contact elements 21 are composed of a band-like or strip-like contact part 60 having a generally planar configuration and having an arc-shaped orientation best seen in FIG. 8. Furthermore, the contact parts 60 are formed with a flange or convexity 61 on one side thereof. The flange or convexity 61 operates to improve the contact characteristics of the contact elements 21 and particularly to increase the contact pressure therebetween.

The contact part 60 extends over into a connection end 22 of the contact element 21. The connection end 22 is formed with a U-shaped cross-sectional configuration formed with a pair of walls or side pieces 23 and 24. The walls 23 and 24 are configured as shown to form the connection end 22 with an asymmetrical cross-sectional shape.

A spring clip 25 is punched or stamped out of the connection end 22 and it is bent upwardly to project laterally forwardly. The spring clip 25 engages within the contact element carrier 2, 12 in order to assist in supporting the contact element 21 in operative engagement.

The connection end 22 of the contact element 21 is also formed with a soldering eye 62 at which electrical connection wire means may be attached by soldering or the like. Of course, wire ends could also be attached by crimping, wire wrapping, insulation displacement and the like.

In order to insert the contact element 21 into the contact element carrier, it is preferred that this be done after a wire end has been attached to the connection end 22 of the element 21. The element 21 may then be inserted into the contact element carrier in the direction of the arrow 55, that is, from the rearward side of each of the respective connector members 3, 13. The contact elements 21 are inserted in recesses provided for this purpose in the cylindrical sections formed in the contact element carriers 2, 12, e.g., the grooves or recesses 4 extending through the contact element carrier 2. It will be seen, particularly from FIG. 6, that the contact element 21 will engage one end of the groove 4 in the carrier 2, with the spring clip 25 engaging in a recess provided for this purpose. The contact element 21 will thus be fixed in place in the contact element carrier and, of course, it will be obvious that the contact elements will be attached similarly in each of the carriers 2 and 12. For example, referring to FIG. 7, it will be seen that the contact element carrier 12 is formed with grooves 14 having an undercut section at one end thereof and that, by insertion of the contact elements 21 in the direction of the arrow 55, the contact ends of the elements 21 may engage within the undercut portion of the grooves 14 and the spring clips 25 may engage in recesses provided for this purpose in order to firmly hold the contact element 21 in place within the carrier 12.

Since the connection end 22 of each of the contact elements 21 is formed with an asymmetrical configuration, this ensures that the contact elements 21 will be inserted into the respective contact element carriers 2, 12 only in a correct position corresponding to the shape of the receiving opening formed in the respective contact element carrier which is likewise shaped asymmetrically in correspondence with the cross-section of the connection end 22 in order to ensure proper positioning thereof. Of course, instead of a U-shaped cross-section for the asymmetrically constructed connection end, other cross-sections may be asymmetrically formed, for example, an L-shaped cross-section may, by way of example, be provided.

As shown in FIG. 6, the contact elements 21 project out in the grooves 4 in which they are received and they only project over these grooves to a slight degree. The geometric preference plane of the contact element 21 is located substantially at a right angle relative to the circumferential contour of the cylindrical section 6. As to this geometric preference plane, it should be noted in this context that it is located at a right angle relative to the plane of projection with reference to FIG. 8 and, with reference to FIG. 9, in the plane of projection or parallel thereto, respectively.

The second or female connector member 13 has its contact element carrier 12 fixedly supported in the connector housing sleeve 11 in a manner similar to that described in connection with the carrier 2 in FIG. 1. However, the contact element carrier 12 is constructed in the form of a hollow cylinder having a cylindrical section 15 with a larger diameter and a cylindrical section 16 with a smaller diameter, as best seen in FIG. 4. Again, the clamping sleeve 17 is arranged as shown in FIGS. 2 and 3 to contact the contact element carrier 12 from the rear side of the connector member and to press against the latter toward the left as viewed in FIGS. 2 and 3 by operation of the clamping ring 26 which is screwed onto the thread 7 of the housing 11.

An annular groove 57 is formed on the inner side 56 of the forward area of the housing 11. The cylindrical section 16 of the contact element carrier 12 is constructed as a hollow cylinder and it will be apparent from FIG. 3 that the contact element carrier 2 is adapted to be located within this hollow cylinder when the contact elements 21, 21 of the members 3, 13 are brought into electrically conductive engagement.

With regard to the contact elements 21 mounted in the contact element carrier 12 of the connector member 13, it will be seen that these contact elements are arranged in such a way that their geometric preference plane lies tangentially relative to the inner circumferential contour of the contact element carrier 12.

Thus, if the two connector members 3 and 13 are joined or plugged together, then the preference planes of the contact elements 21 enclose a right angle with respect to one another as shown in an oblique view in FIG. 10 a scale considerably enlarged relative to the other figures of drawing wherein, for the sake of clarity, the contact elements 21 are shown as not touching each other in FIG. 10 but are assumed to be brought into abutting engagement to form an electrically conducting contact. FIG. 10 is primarily intended to show the geometric preference planes of the two contact elements as being arranged at right angles relative to one another. The contact elements 21 are supported in the contact element carriers 2 and 12 in such a way that only those surfaces necessary for producing contact project forward. This can also be seen from the drawings in an enlarged scale of the contact element carriers 2 and 12 according to FIGS. 6 and 7.

Thus, to reiterate, it will be seen particularly from FIGS. 8, 9, and 10 that the contact elements 21 are formed with at least parts thereof having a generally planar configuration. It will be seen that the plane of the contact elements 21 is, in FIG. 8, perpendicular to the plane of the drawing and in FIG. 9 parallel to the plane of the drawing. Furthermore, it will be seen that the contact elements mounted in the contact element carrier 2 are arranged so that these planes are perpendicular to the planes of the contact elements mounted in the carrier 12 of the connector member 13. Thus, when the connector members 3 and 13 are plugged together as shown in FIG. 3, the planes of the contact elements 21 of one of the connector members will extend perpendicularly to the planes of the contact elements 21 of the other connector member, and this arrangement is best depicted in FIG. 10.

Thus, in accordance with the improvements provided by the present invention, certain characteristics are attained by means of this construction. These characteristics give rise to significant advantages. For example, with the arrangement of the invention, large contact surfaces are provided thereby preventing high current densities. Furthermore, low constant contact resistance will occur even after a large number of actuations. Due to the arrangement of the contact elements, constant contact forces will occur thereby avoiding fatigue, and excellent self-cleaning characteristics arise during connection of the elements without destruction of the actual contact material, i.e., without excessive local scratching of the surfaces due to surface pressure. As a result of the bent or curved structure of the contact element 21, the contact surface of the tangentially arranged contact element curves outwardly while the two ends thereof lie approximately in the same plane. By means of the effect of the force of the contact element which is radially arranged of the other connector part, the front end displaces in a sliding manner on the contact element carrier. The contact force is effected from the force required to deform or twist the curved or bent part. It is particularly advantageous that the curve or bend in the corresponding contact element which is located approximately perpendicularly or vertically relative to the tangentially arranged contact element exerts a cleaning action in the manner of a plowshare when the two corresponding connector parts are plugged together and push away possible impurities to the side. Furthermore, a particularly large area and intimate contact of the contacts results in that the contact surface has no straight line, but rather a spatial curve with a much better adaptation to the surfaces since the tangentially arranged contact element is acted upon or stressed at its longitudinal axis as well, that is, in the form of a rotational bending. The connection end 22 of the contact element according to the invention is constructed in such a way, known per se, that the connection wires can be soldered on as well as fastened in some other form.

FIG. 3 shows the two connector members 3 and 13 in longitudinal section. The detents 30 are engaged in the groove 57. In order to release the connection between the connection members 3 and 13, the sleeve 1' is pulled to the left and slidingly moved axially relative to the sleeve 1". As a result, the sides of the notches 51 will engage and slide along the slanted outer surfaces of the detents 30 and apply a radially inwardly directed force thereto which tends to press the detents 30 radially inwardly. As a result, the detents 30 will be released from engagement within the grooves 57 and the mechanical interlocking of the members 3 and 13 will be released so that the members may be pulled apart.

For the sake of clarity, each of the connector members 3 and 13 is shown with only one contact element 21 mounted therein. However, as shown in FIGS. 6 and 7, it is possible to mount a plurality of contact elements 21 in the contact element carriers 2 and 12, and the contact elements may be distributed at regular or irregular intervals on the circumference of the respective contact element carrier. The embodiments shown herein do not show radial positioning of the housing which enables the connector members 3 and 13 to be joined only in a predetermined radial position relative to each other. However, such arrangement should be assumed.

The contact element carriers 2 and 12 are constructed as hollow cylinders. Of course, it is possible within the scope of the invention to provide other geometric configurations such as rectangular or polygonal.

Figure 12:
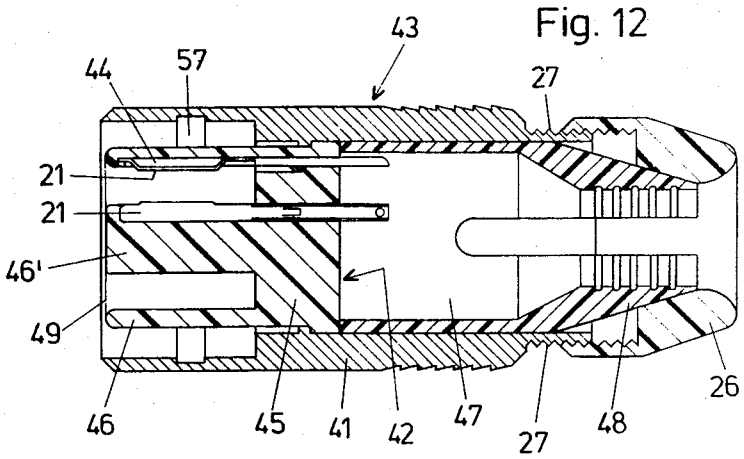
FIGS. 11 and 12 are sectional views showing, respectively, a first and a second connection member for a connector assembly in accordance with a second embodiment of the invention.
Figure 11:
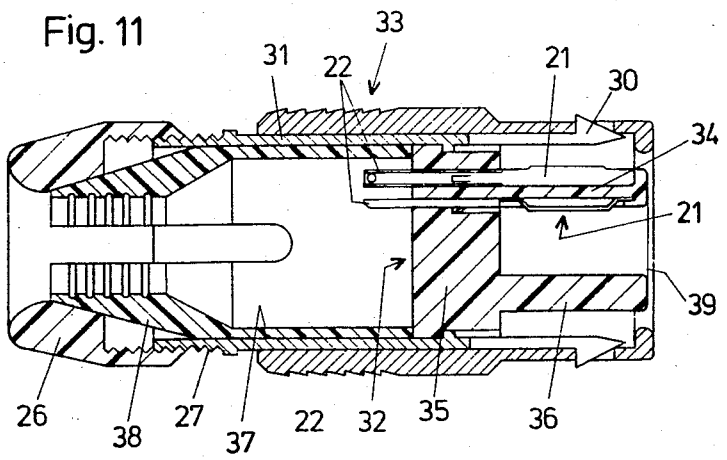
Figure 13:
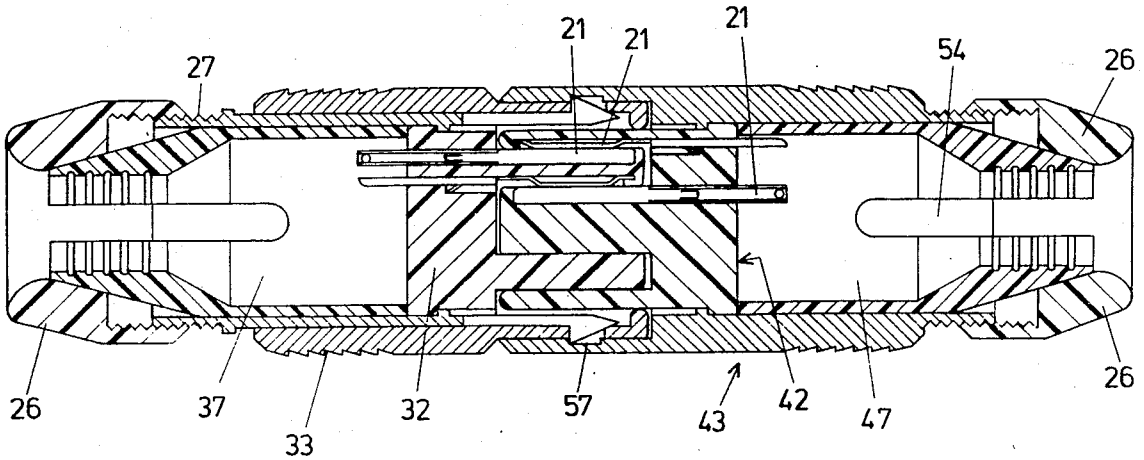
FIG. 13 is a sectional view showing the connection members of FIGS. 11 and 12 plugged together.

FIGS. 11–13 show a further embodiment of the invention wherein, in order to accommodate as many contact elements 21 as possible for each of two connector members 33, 43 shown respectively in FIGS. 11 and 12, contact element carriers 32 and 42 are provided which are constructed with hollow cylindrical sections 36 and 46 on the front sides thereof. The hollow cylindrical sections 36 and 46 fit inside one another, as seen in FIG. 13, and it is significant that contact elements 41 be provided at the inner surface as well as at the outer surface of the hollow cylinders 36, 46 wherein it is preferable that the contact elements at the outside be arranged so as to be offset by 90° relative to the contact elements at the inside of the hollow cylindrical section with reference to the longitudinal axis. The contact elements 21 at the inside and outside of the hollow cylindrical sections can lie in the same diameter planes; however, the outer contact elements 21 can also be offset, in accordance to the angle, relative to the inner contact elements.

Also, in these structures, the contact element carriers 32 and 42 have cylindrical sections 35 and 45 with an enlarged diameter which contacts at the inside of the housing 31 and 41 and are fixed here in accordance with the position by means of clamping sleeves 37 and 47, respectively, in connection with a clamping ring 26 screwed onto threads 27 at the ends of the connection members.

The foregoing applies in a completely analagous manner to the cooperation of the contact elements 21 forming a contact pair, which cooperation results when the two connector parts 33 and 43 are joined together.

In order to protect the contact elements 21, it is provided in all of the embodiments shown that respective front sides 9, 19, 39, and 49 of the contact element carriers are somewhat offset to the rear relative to the corresponding front faces of the housing means 1, 11, 31, and 41. However, beyond this, the ends of the contact elements 21 are offset to the rear relative to the front faces of the contact element carriers and are gripped additionally in undercuts so that the ends of the contact elements are securely and reliably supported. This will be clearly seen particularly from FIGS. 6 and 7 wherein the construction for gripping the contact element ends is clearly exemplified.

The individual structural component parts of the connector members 3, 13, and 33, 43, respectively, are dimensioned in such a manner that they may be mutually exchangeable if desired. It is readily possible to remove the contact element carrier 2 from the connector member 3 and insert it into the connector member 13 and to proceed in a corresponding manner with the contact element carrier 12 of the connector member 13. As already mentioned, the contact elements 21 for all of the connector members 3, 13, 33, and 43 are constructed in a completely identical manner, and the same applies of course for the clamping sleeves 7, 17 and for the clamping rings 26.

In the embodiment shown, the contact element carriers are formed as cylindrical bodies. It is of course also possible to construct these contact element carriers with rectangular or polygonal configurations and in such a case, the contact elements will no longer be supported at cylindrical surfaces but on flat surfaces. Each plug connection shown and described has a connector housing. However, for certain connection purposes it is possible to dispense with the connector housing itself and such construction also falls within the scope of the invention.

Thus, it will be seen from the foregoing that the present invention comprises an electrical plug connector which comprises two connector members paired together with contact element carriers 2, 12 of the two connector members 3, 13 having strip-like or band-like contact elements 21, with the contact elements 21 being supported along their length on one side. These are arranged with their geometric preference planes substantially at a right angle relative to one another. The contact elements 21 of the two connector members 3, 13, each of which forms a contact pair, are identically constructed and thus, in order to produce a contact pair, two equal and identical elements can be employed which considerably simplifies the production as well as the assembly of the invention.

While specific embodiments of the invention have been shown and described in detail to illustrate the application of the inventive principles, it will be understood that the invention may be embodied otherwise without departing from such principles.

What is claimed is:

1. An electrical connector assembly formed of a first and a second connector member adapted to be plugged together to establish electrical connection therebetween, each of said first and second connector members comprising:

housing means;

contact element carrier means made of electrically insulating material mounted within said housing means;

elongate contact elements mounted in said carrier means having longitudinal axes and adapted to be placed in electrically conducting engagement with each other in pairs with said longitudinal axes of each member of a contacting pair extending parallel to each other when said first and second connector members are plugged together;

all of the contact elements in said assembly in both said first and second connector members being identically structured, with each of said contact elements consisting of a connection part having a generally planar configuration for mounting said contact elements in said carrier means so that the planar configurations of the connection parts of the contact elements in one of said first and second connector members are arranged to extend within planes perpendicular to the planes of the planar configurations of the connection parts of the contact elements in the other of said first and second connector members when said connector members are plugged together, and contact parts shaped with a generally arched configuration extending outwardly from said connection parts, said arched configuration having a convex side, a concave side and a pair of opposed edges having said convex and concave sides extending therebetween;

means mounting said contact elements in said connector members to enable flexure of said contact parts by application of pressure on said convex side thereof;

said contact elements being arranged in said connector members so that when said connector members are plugged together electrical contact is established between the contact elements thereof by abutting engagement of one of said edges of a contact part of one contact element against said convex side of a contact part of another mating contact element;

said contact elements being rigid against pressure applied to said edges and operating to effect flexure of those of said contact elements upon which pressure is applied against said convex side by an edge of another contact element thereby to enhance electrical contact therebetween;

each of the contact elements in one of said first and second connector members being mounted with an orientation turned 90° relative to the orientation of the mating contact element in the other of said connector members.

2. An assembly according to claim 1 wherein said contact elements are formed with connection ends having side walls extending perpendicularly to the planar parts thereof with each of said contact elements having side walls on one side which are a different height than the side wall on the opposite side to form said connection end with a U-shaped configuration.

3. An assembly according to claim 1 wherein said carrier means of one of said connector members is constructed with its length formed as a stepped cylindrical member having a smaller diameter portion and a larger diameter portion with the smaller diameter portion thereof carrying said contact elements on its cylindrical wall and wherein the carrier means of said other connector member is constructed as a hollow cylinder with said contact elements arranged at its inner wall, the outer diameter of said smaller diameter portion and the inner diameter of said hollow cylinder being correspondingly constructed relative to each other.

4. An assembly according to claim 1 wherein the carrier means of said first connector member is constructed with a cylindrical configuration comprising a cylindrical section having a smaller outer diameter and a cylindrical section having a larger outer diameter, said cylindrical section having the smaller outer diameter being formed as a hollow cylinder carrying said contact elements on the inside and on the outside thereof and wherein the carrier means for said second connector member is formed with a cylindrical section which carries thereon said contact elements, said cylindrical section being constructed as a hollow cylinder having said contact elements on the inside thereof with a central cylindrical shaft being arranged in said hollow cylinder, said shaft also having said contact elements thereon.

5. An assembly according to claim 1 wherein said carrier means of said first connector member is constructed as a hollow cylinder which receives therein the carrier means of said second connector member so as to enclose said carrier means of said second connector member when said first and second connector members are plugged together, said carrier means of both said first and said second connector members being formed with a generally cylindrical configuration, and with said contact elements mounted in one of said carrier means being arranged with the planes of said planar parts extending tangentially relative to said cylindrical configuration of said carrier means and with the contact elements of the other of said carrier means being arranged to extend radially relative to said cylindrical configuration.

6. An assembly according to claim 1 wherein the carrier means for at least one of said connector members has an inside and is constructed as a hollow cylinder having grooves on the inside thereof, said grooves having ends formed with an undercut configuration wherein said contact elements are engaged in order to support said contact elements on said carrier means, said contact elements being arranged to lie within said grooves with the planes of said planar parts arranged to extend substantially tangentially relative to said cylindrical configuration of said carrier means and to be gripped in said undercut configuration at ends thereof.

7. An assembly according to claim 1 wherein said carrier means are formed with grooves within which said contact elements are mounted, said contact elements being slidable within said grooves from one end of said carrier means, said contact elements including spring clip means for fixing said contact elements within said carrier means.

8. An assembly according to claim 1 wherein said carrier means comprise sides thereof which lie flush against sides of said housing means.

9. An assembly according to claim 1 wherein said housing has an inner wall and said carrier means of both said first and said second connector members are formed with parts thereof arranged to contact said inner wall of said housing means in order to secure said carrier means against relative axial displacement within said housing means, said contacting parts having identical cross-sectional dimensioning so that the carrier means of each of said first and second connector members may be interchangeable relative to said housing means.

10. An assembly according to claim 1 wherein said contact element carrier means are formed with a polygonal cross-sectional configuration and wherein said carrier means include flat surfaces against which said contact elements are arranged.

11. An assembly according to claim 1, wherein the contact element carrier means of at least one of said first and second connector members is arranged with the contact elements thereof lying in grooves provided in the contact element carrier means at least over their contact length, said contact elements extending beyond said grooves only by the surfaces thereof serving for establishment of direct contact with the contact elements of the other of said first and second connector members.

12. An assembly according to claim 1 wherein said housing means has an inner wall, said carrier means for one of said connector members is formed with a stepped cylindrical configuration including a larger diameter cylindrical section and a smaller diameter cylindrical section, said larger diameter cylindrical section being arranged in contact with said inner wall of said housing means and said smaller diameter cylindrical section having grooves therein for receiving said contact elements, said contact elements including connection ends opposite said contact portions which extend through openings provided in said larger diameter cylindrical section and which project forwardly relative to these openings.

13. An assembly according to claim 12 wherein said contact elements are arranged with the planes of said planar parts extending radially relative to said cylindrical configuration of said carrier means.

14. An assembly according to claim 12 wherein said cylindrical section of said carrier means having said grooves for receiving said contact elements is constructed as a hollow cylinder having said contact elements at its outer and inner cylinder wall.

15. An assembly according to claim 14 wherein said grooves are shorter than the axial length of said cylindrical section on which said grooves are formed and wherein said grooves have front ends which lie behind the front side of said contact element carrier means.

* * * * *